US011340052B2

(12) United States Patent
Cleveland

(10) Patent No.: US 11,340,052 B2
(45) Date of Patent: May 24, 2022

(54) WING DEPLOYMENT INITIATOR AND LOCKING MECHANISM

(71) Applicant: BAE SYSTEMS Information and Electronic Systems Integration Inc., Nashua, NH (US)

(72) Inventor: Kenneth D. Cleveland, Hollis, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 293 days.

(21) Appl. No.: 16/552,575

(22) Filed: Aug. 27, 2019

(65) Prior Publication Data

US 2021/0063127 A1 Mar. 4, 2021

(51) Int. Cl.
*F42B 10/14* (2006.01)
*F42B 10/64* (2006.01)

(52) U.S. Cl.
CPC ..... *F42B 10/14* (2013.01); *F42B 10/64* (2013.01)

(58) Field of Classification Search
CPC ..... F42B 10/14; F42B 10/26; F42B 10/64
See application file for complete search history.

(56) References Cited

U.S. PATENT DOCUMENTS 3,413,640 A 11/1968 Freeman et al.
3,803,751 A 4/1974 Pippin, Jr.
3,861,627 A 1/1975 Schoffl
3,918,664 A 11/1975 Grosswendt
3,921,937 A 11/1975 Voss et al.
3,965,611 A 6/1976 Pippin, Jr.
3,990,656 A 11/1976 Minnich
(Continued)

FOREIGN PATENT DOCUMENTS

DE 1531357 A1 1/1970
EP 2416104 A2 * 2/2012 ..... F42B 10/14
(Continued)

OTHER PUBLICATIONS

International Search Report, PCT/US20/47971, dated May 4, 2021, 9 pages.

(Continued)

*Primary Examiner* — Benjamin P Lee
(74) *Attorney, Agent, or Firm* — Maine Cernota & Rardin; Gary McFaline

(57) ABSTRACT

A wing deployment initiator initiates penetration of frangible cover seals by missile guidance wings during wing deployment. The initiator includes a central, rotatable hub extending above a baseplate. Lobes extending from the hub prevent rotation of associated flippers by torsion springs. Locking and deployment tabs extend from the flippers into corresponding notches in proximal ends of the wings. The locking tabs prevent deployment of the wings until the central hub is rotated, whereupon the flippers are released, causing the deployment tabs to transfer deployment energy from the torsion springs to the wings. The hub can be rotated by an electrical actuator such as a solenoid or motor, or the lobes can be rotationally offset so that feedback pressure from the flippers applies a torque to the hub, and missile electronics can cause a wing control surface to inhibit and then enable hub rotation via a rocker link.

21 Claims, 16 Drawing Sheets

(56) References Cited

U.S. PATENT DOCUMENTS

| | | | | |
|---|---|---|---|---|
| 4,175,720 | A * | 11/1979 | Craig | F42B 10/14 244/3.28 |
| 4,351,499 | A | 9/1982 | Maudal | |
| 4,411,398 | A | 10/1983 | Wedertz et al. | |
| 4,568,044 | A | 2/1986 | Ditommaso et al. | |
| 4,586,681 | A | 5/1986 | Wedertz et al. | |
| 4,635,881 | A | 1/1987 | Brieseck et al. | |
| 4,691,880 | A | 9/1987 | Frank | |
| 4,838,502 | A | 6/1989 | Pinson et al. | |
| 5,004,186 | A | 4/1991 | Hans et al. | |
| 5,240,203 | A | 8/1993 | Myers | |
| 5,393,011 | A | 2/1995 | Dunn et al. | |
| 5,615,847 | A | 4/1997 | Bourlett | |
| 5,630,564 | A | 5/1997 | Speicher et al. | |
| 5,671,899 | A | 9/1997 | Nicholas et al. | |
| 5,904,319 | A | 5/1999 | Hetzer | |
| 6,119,976 | A | 9/2000 | Rogers | |
| 6,224,013 | B1 * | 5/2001 | Chisolm | F42B 10/14 244/3.27 |
| 6,446,906 | B1 | 9/2002 | Voigt et al. | |
| 6,576,880 | B2 | 6/2003 | Martorana et al. | |
| 6,588,700 | B2 | 7/2003 | Moore et al. | |
| 6,668,542 | B2 | 12/2003 | Baker et al. | |
| 6,880,780 | B1 | 4/2005 | Perry et al. | |
| 7,175,131 | B2 | 2/2007 | Dodu et al. | |
| 7,207,518 | B2 | 4/2007 | Alculumbre et al. | |
| 7,556,220 | B2 | 7/2009 | Schultz | |
| 7,856,929 | B2 | 7/2010 | Gavin et al. | |
| 7,829,829 | B2 | 11/2010 | King et al. | |
| 7,829,830 | B1 | 11/2010 | Rogers | |
| 8,324,544 | B2 | 12/2012 | Palani et al. | |
| 8,415,598 | B1 | 4/2013 | Terhune et al. | |
| 8,476,564 | B2 | 7/2013 | Henry et al. | |
| 8,686,329 | B2 * | 4/2014 | Barry | F42B 10/14 244/3.27 |
| 9,989,338 | B2 * | 6/2018 | Osdon | F42B 10/16 |
| 2006/0071120 | A1 | 4/2006 | Selin et al. | |
| 2006/0163423 | A1 * | 7/2006 | Parine | F42B 10/14 244/3.27 |
| 2008/0082420 | A1 | 4/2008 | Kargman | |
| 2009/0127378 | A1 | 5/2009 | Turner et al. | |
| 2010/0050712 | A1 * | 3/2010 | Tong | B64G 1/222 70/185 |
| 2012/0074256 | A1 | 3/2012 | Pietrzak et al. | |
| 2012/0119014 | A1 * | 5/2012 | Barry | F42B 10/14 244/3.21 |
| 2012/0175460 | A1 * | 7/2012 | Palani | F42B 10/14 244/3.28 |
| 2014/0203134 | A1 * | 7/2014 | Plumer | F42B 10/00 244/3.1 |
| 2016/0349025 | A1 | 12/2016 | Osdon | |
| 2021/0063127 | A1 | 3/2021 | Cleveland | |

FOREIGN PATENT DOCUMENTS

| | | | |
|---|---|---|---|
| EP | 2556327 | B1 | 8/2016 |
| WO | 2002018867 | A1 | 3/2002 |

OTHER PUBLICATIONS

International Preliminary Report on Patentability for Appl No. PCT/US2011/031074 dated Oct. 9, 2012, 5 pages.

International Preliminary Report on Patentability for Appl No. PCT/US2011/031718 dated Oct. 9, 2012, 6 pages.

US Statutory Invention Registration H1219, Aug. 3, 1993, Miller.

International Preliminary Report on Patentability for Appl No. PCT/US2011/031584 dated Oct. 9, 2012, 6 pages.

* cited by examiner

WING DEPLOYMENT INITIATOR AND LOCKING MECHANISM

FIELD

The present disclosure relates to ballistic weaponry, and more particularly to apparatus for deploying guidance wings on folding fin aerial projectiles, rockets, and missiles.

BACKGROUND

Aerial rockets, projectiles, and missiles that include folded, deployable guidance wings or "flaperons" are well known. Modern examples include the Hydra 70 family of WAFARs (Wrap-Around Fin Aerial Rocket) and the APKWS® laser guided missile. FIG. 1 illustrates an APKWS 106 in flight with its guidance wings 110 deployed after being launched from an attack helicopter 100. The projectile 106 is following the reflection 108 of a laser beam 102 directed onto a target 104.

For many such weapons, the guidance wings or flaperons are folded in a stowed configuration within the main fuselage and held in place by a locking mechanism until the weapon is launched, at which point the locking mechanism releases the guidance wings so that they can deploy outward through slots provided in the fuselage.

Typically, the rocket or missile is spun during its flight for increased accuracy and stability. For many missiles and rockets with folded, deployable guidance wings, the guidance wings are released from their folded and stowed configuration upon launch, and are deployed by the centrifugal force which results from the spinning of the projectile in flight.

In some cases, the wing slots are covered by frangible seals which protect the interior of the missile from moisture and debris during storage, transport, and handling. In these cases the guidance wings must be deployed with sufficient initial force to enable them to penetrate through the frangible seals, after which relatively less force is needed to complete the deployment.

Of course, wing deployment through frangible cover seals becomes more dependable as the initial deployment force is increased. However, there is a practical limit to how rapidly a missile can be spun, and unfortunately the centrifugal force that results from spinning the rocket or missile is weakest during the initial stages of deployment, when the wings are within the fuselage and close to the center of rotation. In one example, the average centrifugal force on the tip of a guidance wing at the beginning of deployment is only approximately 7.7 pounds at the minimum spin rate. This amount of centrifugal energy may not be sufficient by itself to enable the wings to burst through the frangible slot covers. If the deployable folded guidance wings are unable to quickly break the frangible wing slot covers and fully deploy, the projectile may not successfully complete its mission.

One approach to break the frangible seal is to incorporate a wing deployment initiator into the rocket or missile that assists the deployment of the guidance wings by providing an initial burst of energy to help the wings break through the frangible covers. Some designs include wing deployment initiators that use explosives to push the wings through the frangible covers. However, this approach can be undesirable due to the violent forces produced by the explosives, and also due to concerns about the safety and the long-term chemical stability of the explosives during storage of the weapon.

Spring-driven wing deployment initiators have been proposed that avoid the problems of using explosives. However, it is desirable to minimize the size and weight of such mechanisms so as to maximize the range and payload capacity of the rocket or missile. Furthermore, it is desirable to minimize the complexity of a deployment initiator, so as to lower the cost of production and also to increase the reliability of the deployment initiator.

What is needed, therefore, is spring-driven wing deployment initiator that is compact, lightweight, reliable, and relatively simple in design.

SUMMARY

The present disclosure is a spring-driven wing deployment initiator that is compact, lightweight, reliable, and simple in design. In addition, the present design is also a wing locking mechanism that maintains the wings in their stowed configuration until they are deployed, thereby further conserving size and weight and further reducing complexity by eliminating any need for a separate locking mechanism.

It should be understood that the terms "wing" and "guidance wing" are used herein generically to refer to any wing, flaperon, fin, or other guidance surface that is configured for stowage within the fuselage of a rocket, projectile, or missile before deployment, and for pivotal deployment extending outside of the fuselage of the rocket, projectile, or missile during deployment. It should further be understood that the terms "rocket" and "missile" are used herein interchangeably to refer in general to any airborne system that has a fuselage within which guidance wings are stowed before launch, and beyond which the guidance wings are deployed during or after launch.

The present design associates a "flipper" with each deployable wing of the rocket or missile. The flipper includes a locking tab that is configured to engage with a locking notch provided at the tip of the wing, and thereby to lock the wing in its stowed configuration within the missile until deployment of the wing is initiated. The flipper further comprises a deployment tab that engages with a deployment notch. In embodiments the deployment tab and notch are provided proximal to and radially inward of the locking notch. A torsion spring is configured to energetically rotate the flipper about a central axis thereof, such that the energy of the spring is transferred by the deployment tab of the flipper to the wing as the flipper rotates and the wing begins its deployment. Rotation of the flipper also causes the locking tab to be withdrawn from the wing so that it is free to burst through the frangible seal with the assistance of the torsion spring and flipper. In embodiments, a single tab and notch function as both the locking and deployment tab and notch, while in other embodiments the locking and deployment tabs and notches are distinct from each other.

While the wing is stowed, the flippers are constrained from rotating by lobes that extend from a central hub. The hub is configured to rotate about an axis that is coaxial with a central axis of the missile, so that rotation of the hub causes the lobes to rotate out of contact with the flippers, thereby allowing the flippers to rotate and allowing the wings to be deployed. In embodiments, the lobes contact the flippers via rollers or ball bearings so as to facilitate rotation of the hub despite the pressure that is applied radially inward against the lobes by the flippers.

In some embodiments, a linkage operated by an electrical actuator such as rotary solenoid or DC motor is used to maintain the rotational position of the hub while the missile is stowed, and to rotate the hub after launch so as to initiate deployment of the guidance wings.

In other embodiments wherein the guidance wings include rotatable control surfaces, one of the control surfaces is used to prevent rotation of the hub when the wings are stowed. In some of these embodiments, when the wings are stowed, the hub is maintained in a first orientation that causes the lobes to be somewhat off-center on the faces of the flippers, so that the pressure applied to the lobes by the flippers results in a rotational torque applied to the hub. Before deployment, in embodiments this torque is resisted via a rocker link that is blocked by the wing control surface and in turn prevents movement of a pin that is fixed to the hub. For example, in embodiments the wing control surface is driven by the missile electronics via a motor and gear train, wherein the gear train is designed such that the control surface cannot be back-driven, and so the force applied to the control surface by the hub via the rocker link cannot cause the control surface to rotate. In these embodiments, wing deployment is initiated simply by causing the wing electronics to rotate the control surface away from the rocker link, for example to a "faired" position that is in line with the remainder of the wing, whereupon the rocker link is free to pivot, allowing the pin to move and allowing the torque applied by the flippers to the lobes to rotate the hub about its axis until the lobes are rotated away from the flippers and the flippers are free to rotate and thereby to initiate deployment of the wings.

One general aspect of the present disclosure is a wing deployment initiator configured for initiating deployment from a stowed configuration of a guidance wing of a projectile. The wing deployment initiator includes a flipper configured to be rotated from a first flipper position to a second flipper position by a deployment spring, the flipper when in the first flipper position being configured to retain the guidance wing in its stowed configuration, the flipper when rotated from the first flipper position to the second flipper position being configured to release the guidance wing and to transfer deployment energy from the deployment spring to the guidance wing, thereby energetically initiating deployment of the guidance wing, and a central hub configured to be rotated about a vertical hub axis by a hub actuator, the central hub including a lobe extending radially toward the flipper, said lobe being configured to maintain the flipper in the first flipper position when the central hub is in a first hub orientation, and to permit the flipper to rotate to the second flipper position when the central hub is in a second hub orientation.

In embodiments, the flipper is pivotally mounted to a horizontal initiator baseplate and extends above an upper surface of the initiator baseplate, said flipper being radially offset from the central hub along an offset radius extending from the central hub to the flipper, the flipper being configured to rotate about a horizontal flipper axis that is perpendicular to the offset radius.

In any of the above embodiments, the deployment spring can be a torsion spring.

In any of the above embodiments, the lobe can be in abutting contact with a radially inward facing surface of the flipper when the hub is in the first hub orientation and the flipper is in the first flipper position, thereby inhibiting the flipper from rotating, and the lobe can be rotationally offset from the flipper when the central hub is in the second hub orientation, thereby enabling the flipper to rotate from the first flipper position to the second flipper position. In some of these embodiments, the lobe comprises a bearing or roller configured to roll against the radially inward facing surface of the flipper as the hub is rotated from the first hub orientation to the second hub orientation.

In any of the above embodiments, the flipper can further include a locking flipper tab and a deployment flipper tab configured such that when the guidance wing is in its stowed configuration and the flipper is in the first flipper position, the locking flipper tab engages with a corresponding locking wing notch provided in the guidance wing, whereby mutual engagement of the locking flipper tab and locking wing notch restrains the guidance wing from being deployed, and as the flipper rotates from the first flipper position to the second flipper position, the deployment flipper tab transfers the deployment energy from the deployment spring to the guidance wing. In some of these embodiments, the locking flipper tab is the deployment flipper tab, while in other of these embodiments the locking flipper tab is distinct from the deployment flipper tab.

In any of the above embodiments, the guidance wing can be included in a plurality of guidance wings that are symmetrically located about the vertical hub axis, and for each of the guidance wings the wing deployment initiator can include a corresponding lobe, flipper, and spring configured to maintain the guidance wing in its stowed configuration when the central hub is in the first hub orientation, and to energetically initiate deployment of the guidance wing when the central hub is rotated by the actuator to the second hub orientation.

In any of the above embodiments, the actuator can be an electrically driven actuator. In some of these embodiments, the actuator is a rotary solenoid or DC motor that is coupled to the central hub by a linkage.

Or, in any of the above embodiments, the guidance wing can include a control surface that can be deflected by control electronics of the projectile, the flipper can be offset from the central hub along a flipper offset radius extending from the central hub to the flipper, and the lobe can extend radially outward from the central hub along a lobe radius, such that when the central hub is in its first orientation, the lobe abuts an inward facing surface of the flipper, but the lobe radius is not aligned with the flipper offset radius, such that pressure applied to the lobe by the flipper arising from torque applied to the flipper by the deployment spring results in application of a feedback torque to the central hub, and the actuator can be configured such that rotation of the central hub is inhibited by the control surface when the control surface is in a first control surface alignment, and rotation of the central hub according to the feedback torque is enabled when the control surface is moved by the control electronics of the projectile to a second control surface alignment.

In some of these embodiments, the control surface is driven by the control electronics of the projectile via a gear train that cannot be back-driven.

In any of these embodiments, the control surface can be deflected out of alignment with the guidance wing when the control surface is in the first control surface alignment, and the control surface can be in alignment with the guidance wing when the control surface is in the second control surface alignment.

A second general aspect of the present disclosure is a projectile that includes a fuselage, a guidance wing hinged at a distal end thereof so as to enable a proximal end of the guidance wing to pivot outward during a wing deployment thereof through a corresponding wing slot provided in the fuselage, and a wing deployment initiator configured for initiating deployment of the guidance wing from the stowed configuration, where the wing deployment initiator includes a flipper configured to be rotated from a first flipper position to a second flipper position by a deployment spring, the flipper when in the first flipper position being configured to retain the guidance wing in its stowed configuration, the flipper when rotated from the first flipper position to the second flipper position being configured to release the guidance wing and to transfer deployment energy from the deployment spring to the guidance wing, thereby energetically initiating deployment of the guidance wing, and a central hub configured to be rotated about a vertical hub axis by a hub actuator, the central hub including a lobe extending radially toward the flipper, said lobe being configured to maintain the flipper in the first flipper position when the central hub is in a first hub orientation, and to permit the flipper to rotate to the second flipper position when the central hub is in a second hub orientation.

Some of these embodiments further include a frangible seal covering the wing slot, deployment of the guidance wing thereby requiring that the guidance wing penetrate through the frangible seal.

In any of the above embodiments, the lobe can include a bearing or roller configured to roll against a radially inward facing surface of the flipper as the hub is rotated from the first hub orientation to the second hub orientation.

In any of the above embodiments, the guidance wing can be included in a plurality of guidance wings that are symmetrically located about a central axis of the projectile, and wherein for each of the guidance wings the projectile includes a corresponding lobe, flipper, and deployment spring configured to maintain the guidance wing in its stowed configuration when the central hub is in the first hub orientation, and to energetically initiate deployment of the guidance wing when the central hub is rotated by the actuator to the second hub orientation.

In any of the above embodiments, the guidance wing can include a control surface that can be deflected by control electronics of the projectile, the flipper can be offset from the central hub along a flipper offset radius extending from the central hub to the flipper, the lobe can extend radially outward from the central hub along a lobe radius, such that when the central hub is in its first orientation, the lobe abuts an inward facing surface of the flipper, but the lobe radius is not aligned with the flipper offset radius, such that pressure applied to the lobe by the flipper arising from torque applied to the flipper by the deployment spring results in application of a feedback torque to the central hub, and the actuator can be configured such that rotation of the central hub is inhibited by the control surface when the control surface is in a first control surface alignment, and rotation of the central hub according to the feedback torque is enabled when the control surface is moved by the control electronics of the projectile to a second control surface alignment.

In some of these embodiments, the control surface is driven by the control electronics of the projectile via a gear train that cannot be back-driven.

And in any of these embodiments, the control surface can be deflected out of alignment with the guidance wing when the control surface is in the first control surface alignment, and wherein the control surface is in alignment with the guidance wing when the control surface is in the second control surface alignment.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present disclosure is a spring-driven wing deployment initiator that is compact, lightweight, reliable, and simple in design. In addition, the present design is also a wing locking mechanism that maintains the wings in their stowed configuration until they are deployed, thereby further conserving size and weight and further reducing complexity by eliminating any need for a separate locking mechanism.

It should be understood that the terms "wing" and "guidance wing" are used herein generically to refer to any wing, flaperon, fin, or other guidance surface that is configured for stowage within the fuselage of a rocket or missile before deployment, and for pivotal deployment extending outside of the fuselage of the rocket or missile during and after deployment. It should further be understood that the terms "rocket" and "missile" are used herein interchangeably to refer in general to any airborne system that has a fuselage within which guidance wings are stowed before launch, and beyond which the guidance wings are deployed during or after launch.

Figure 1:
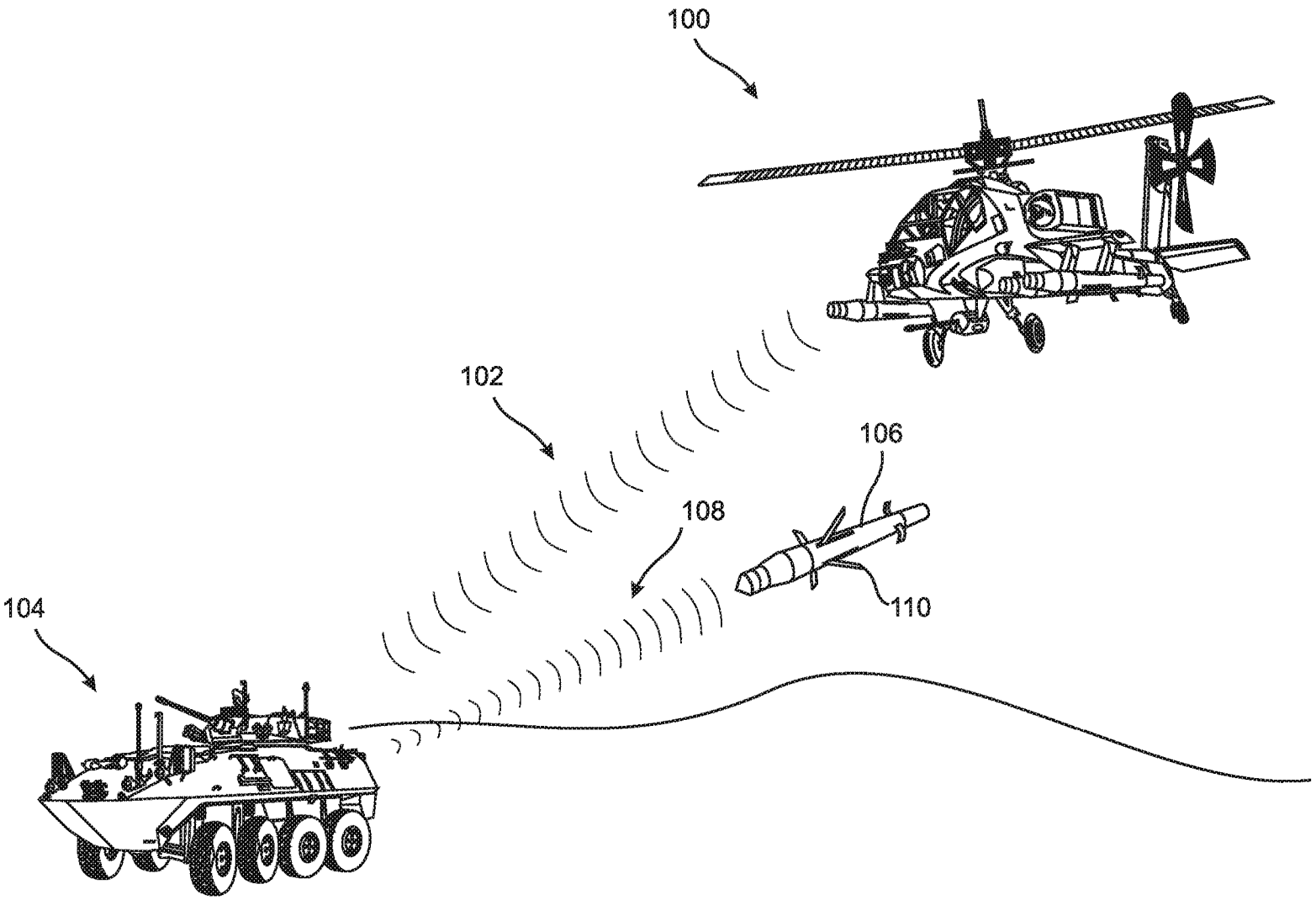
Fig. 1 Prior Art
FIG. 1 is a prior art perspective view of an APKWS having just been launched from a helicopter, showing its guidance wings deployed.
Figure 2A:
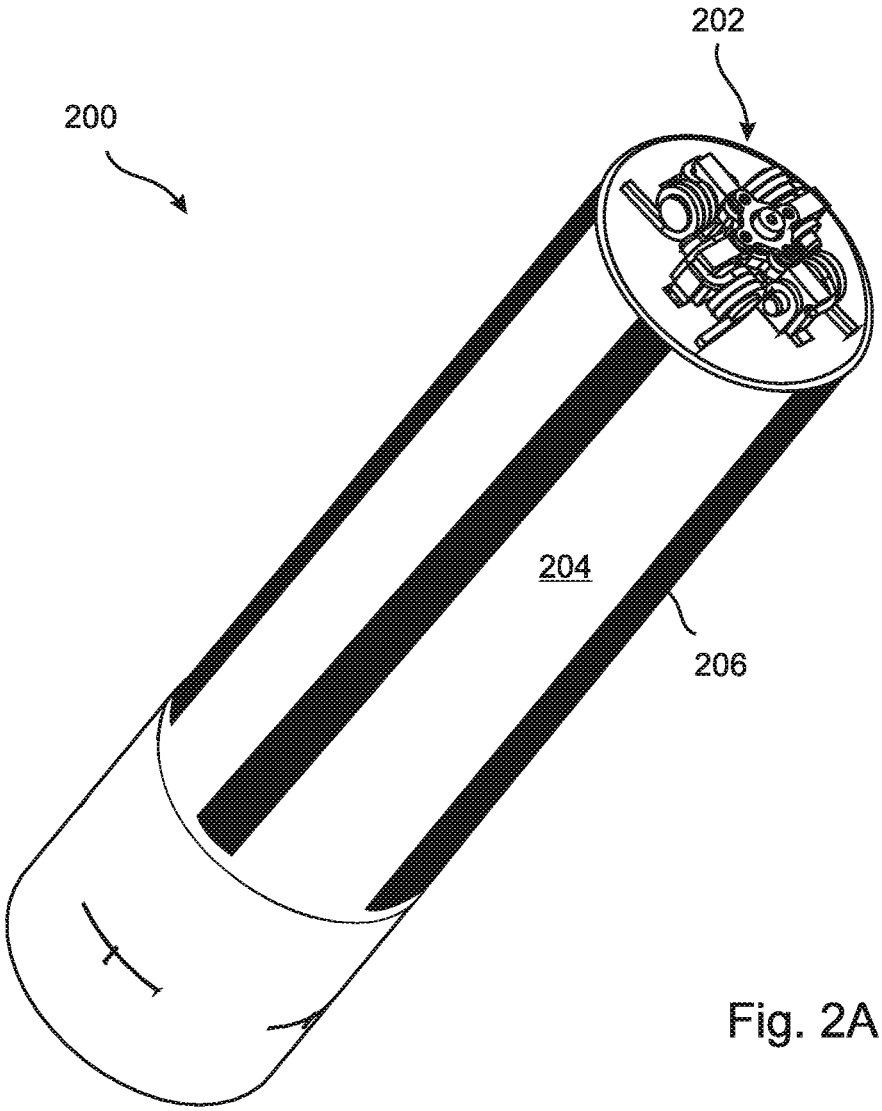
FIG. 2A is a perspective view of the guidance wing section of an APKWS in an embodiment of the present disclosure, shown before wing deployment and with the fuselage and frangible seals in place.
Figure 2B:
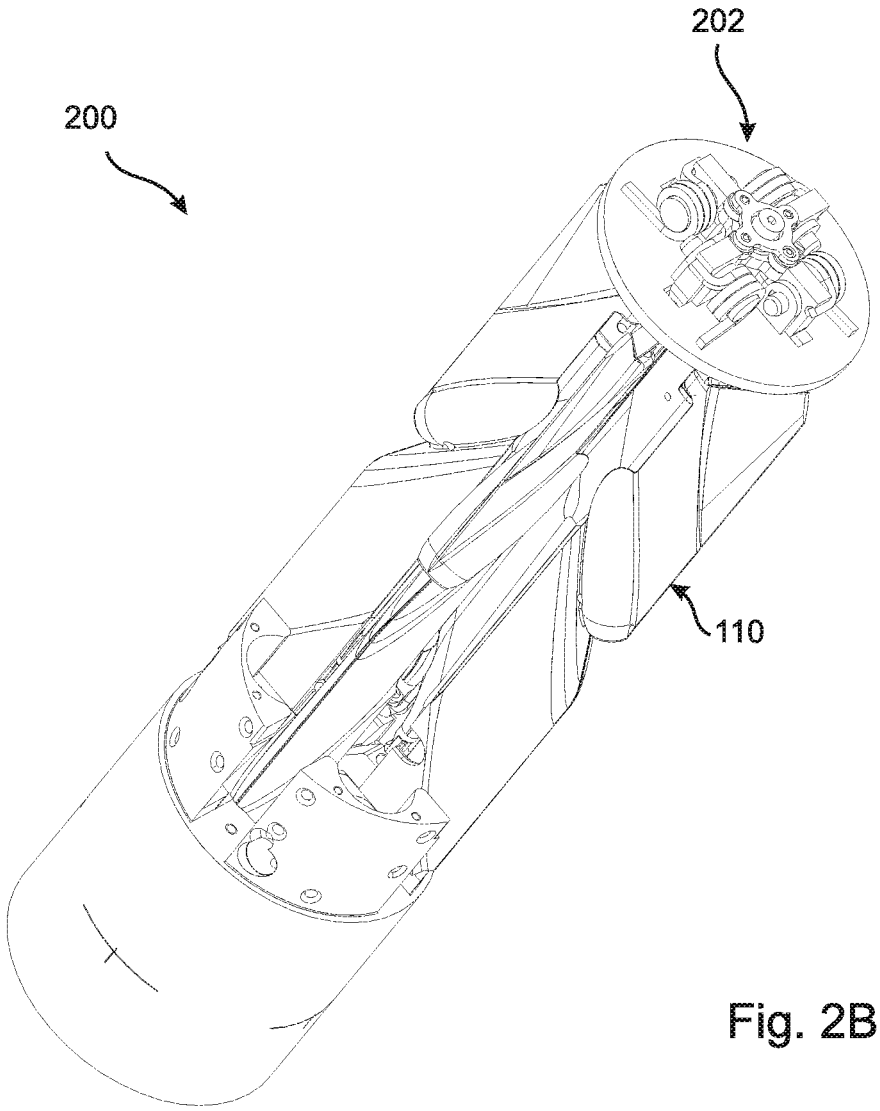
FIG. 2B is a perspective view of the guidance wing section of FIG. 2A, shown with the fuselage removed.
Figure 2C:
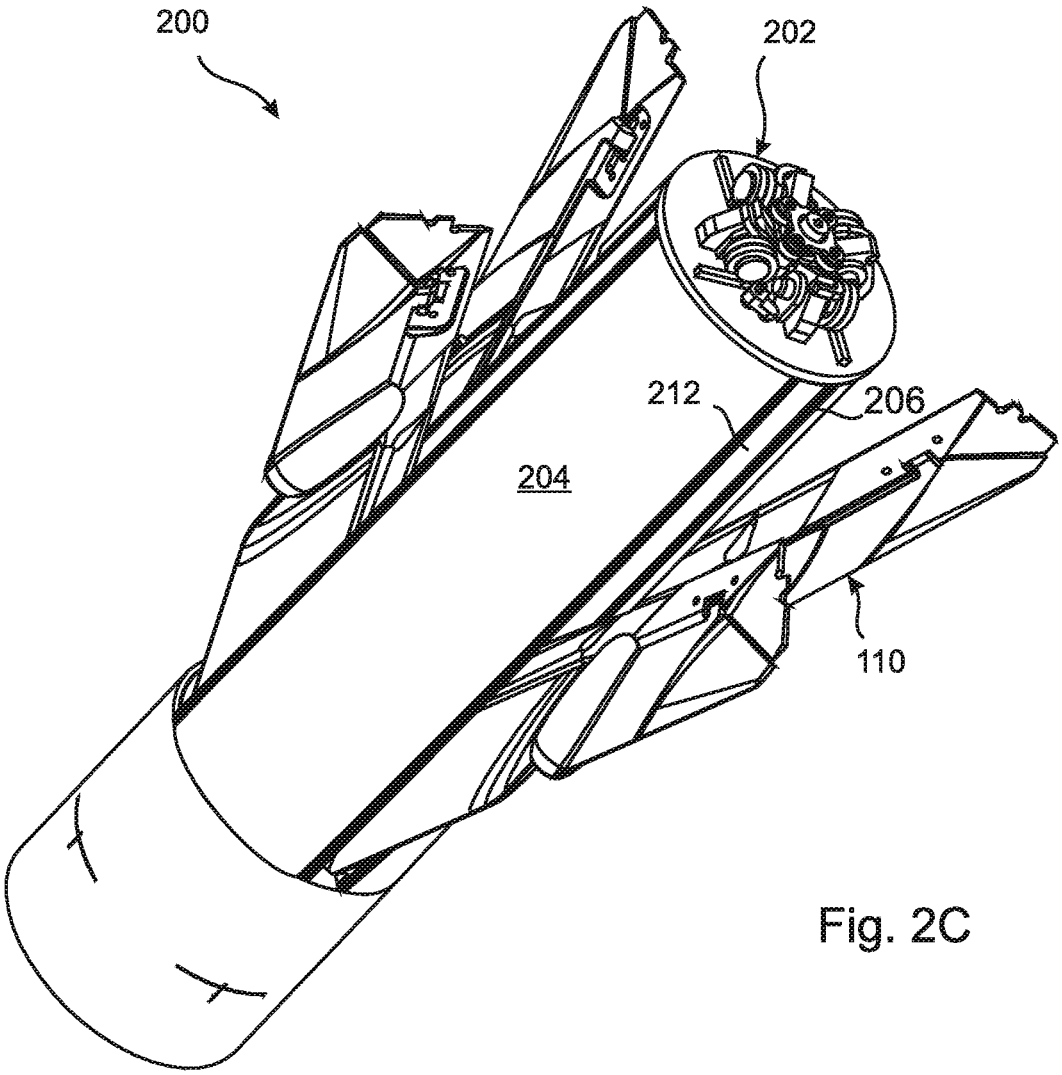
FIG. 2C is a perspective view of the guidance wing section of FIG. 2A, shown with the fuselage in place and the guidance wings partially deployed through the wing slots and frangible seals.

FIGS. 2A-2C illustrate the guidance wing segment 200 of an APKWS 106 in which an embodiment 202 of the presently disclosed wing deployment initiator 202 has been implemented. FIG. 2A shows the segment 200 with the fuselage 204 in place and the wings 110 stowed, FIG. 2B shows the segment 200 with the fuselage 204 removed and the wings 110 stowed, and FIG. 2C illustrates the segment 200 with the fuselage 204 in place, and the guidance wings 110 at least partially deployed. It can be seen in the drawings that the fuselage 204 that covers the guidance wings 110 includes wing deployment slots 212 that are covered by frangible seals 206, such that the guidance wings 110 are required to penetrate through the frangible seals 206 during wing deployment.

Figure 3A:
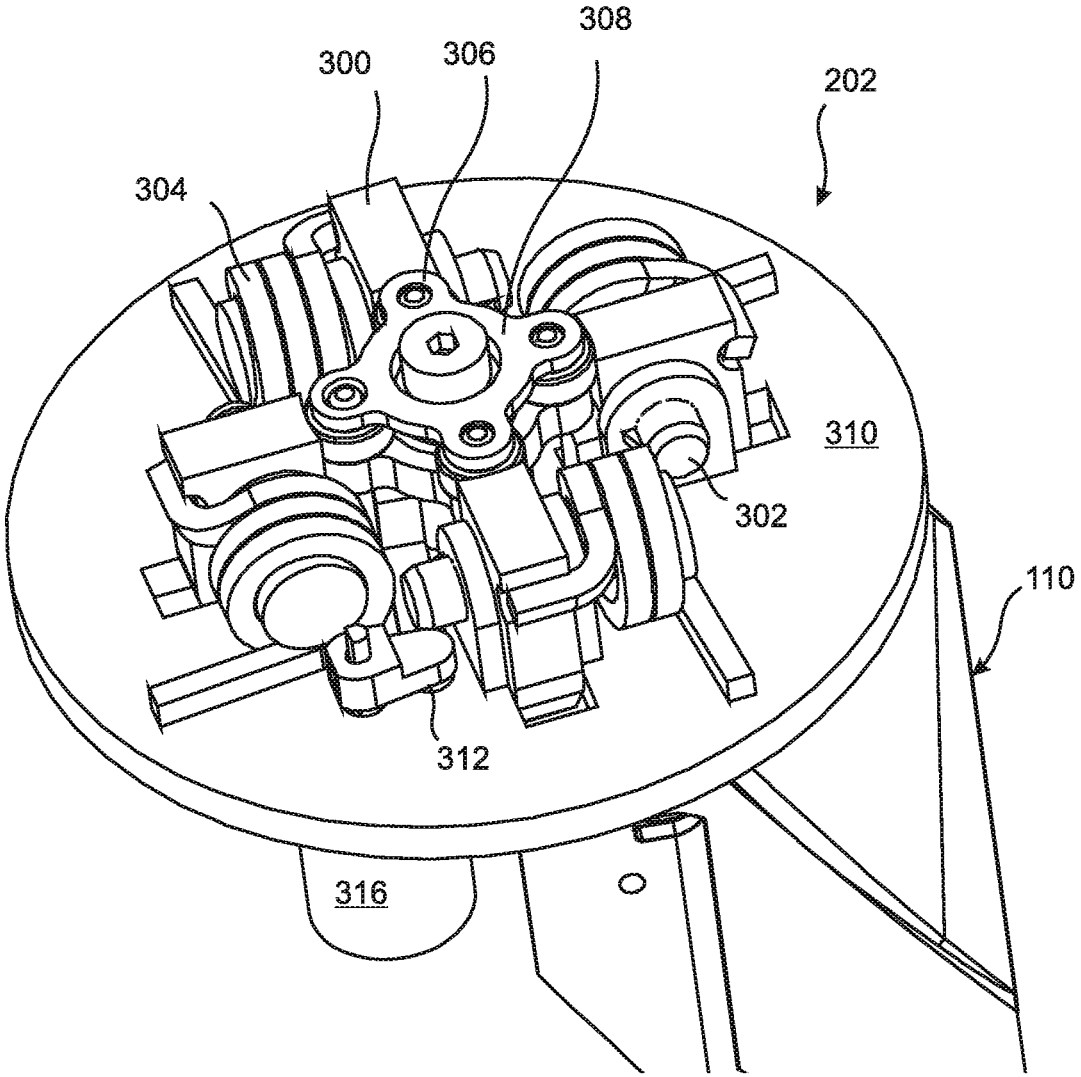
FIG. 3A is a close-up perspective view from above, drawn to scale, of the wing deployment initiator of the present disclosure in an embodiment that includes an electrical deployment actuator, the wing deployment initiator being shown in a configuration before wing deployment has been initiated and being shown with only one wing included.
Figure 3B:
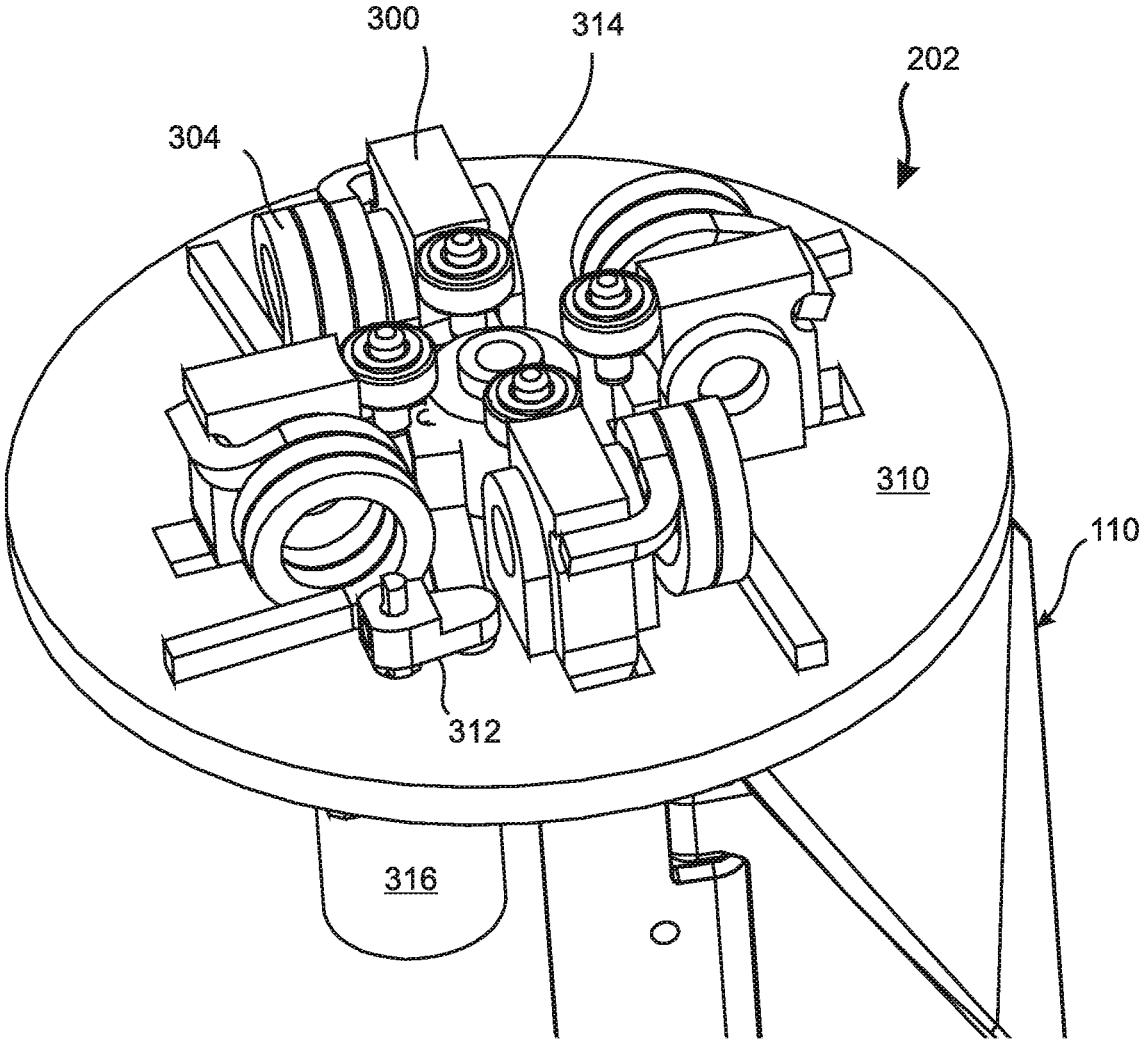
FIG. 3B is a close-up perspective view from above of the embodiment of FIG. 3A, drawn to scale, in which the central hub and some other elements of the wing deployment initiator have been removed so as to expose underlying elements.
Figure 3C:
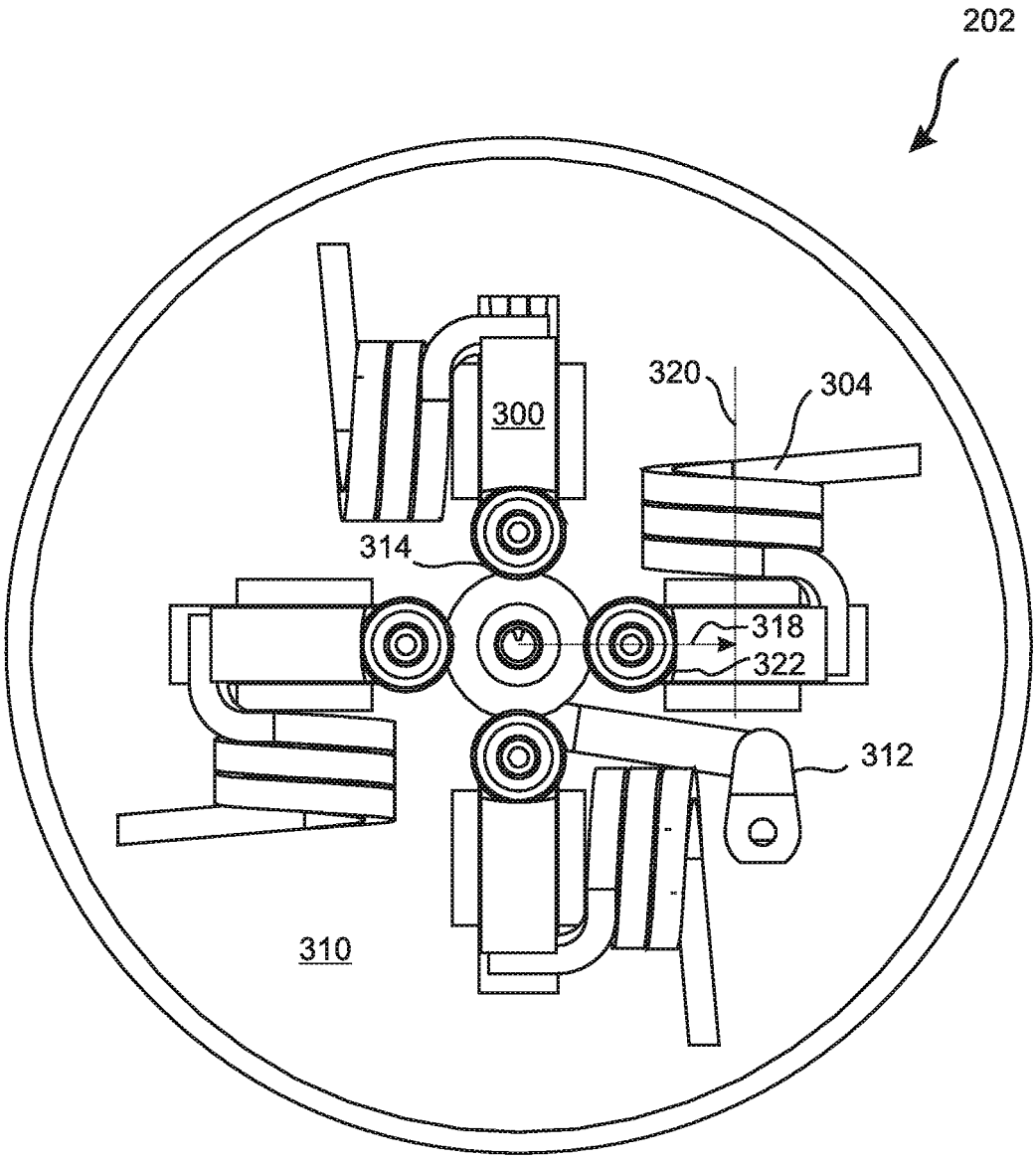
FIG. 3C is a top view drawn to scale of the embodiment of FIG. 3B.

FIGS. 3A and 3B are close-up top perspective views of the wing deployment initiator 202 of the embodiment of FIGS. 2A-2C, where the central hub and some of the other elements of the initiator 202 have been removed in FIG. 3B so that underlying components can be seen. FIG. 3C is a top view of the embodiment of FIG. 3B. Note that, for clarity of illustration, only one of the wings 110 is included in FIGS. 3A and 3B, while all of the wings 110 have been removed in FIG. 3C.

The projectile 106 in the illustrated embodiment includes four guidance wings 110, and the illustrated embodiment of the wing deployment initiator 202 associates a "flipper" 300 with each deployable wing 110 of the projectile 106. Each flipper 300 is mounted on a flipper axel 302 and configured to energetically rotate about a flipper axis 320 in response to a torque applied to the flipper 300 by an associated torsion spring 304. The flipper axis 320 for each of the flippers 300 is oriented parallel to the underlying initiator baseplate 310 and perpendicular to an offset radius 318 extending from the central hub 308 to the flipper 300.

When the wings 110 are stowed, as shown in FIGS. 3A-3C, rotation of the flippers 300 is inhibited by associated lobes 306 that extend from a central hub 308 and abut radially inward facing surfaces 322 of the flippers 300. In the embodiment of FIGS. 3A-3C, the lobes 306 include rollers 314 that rest against the radially inward facing surfaces 322 of the flippers 300 and prevent the flippers 300 from rotating about the flipper axels 302.

Figure 4A:
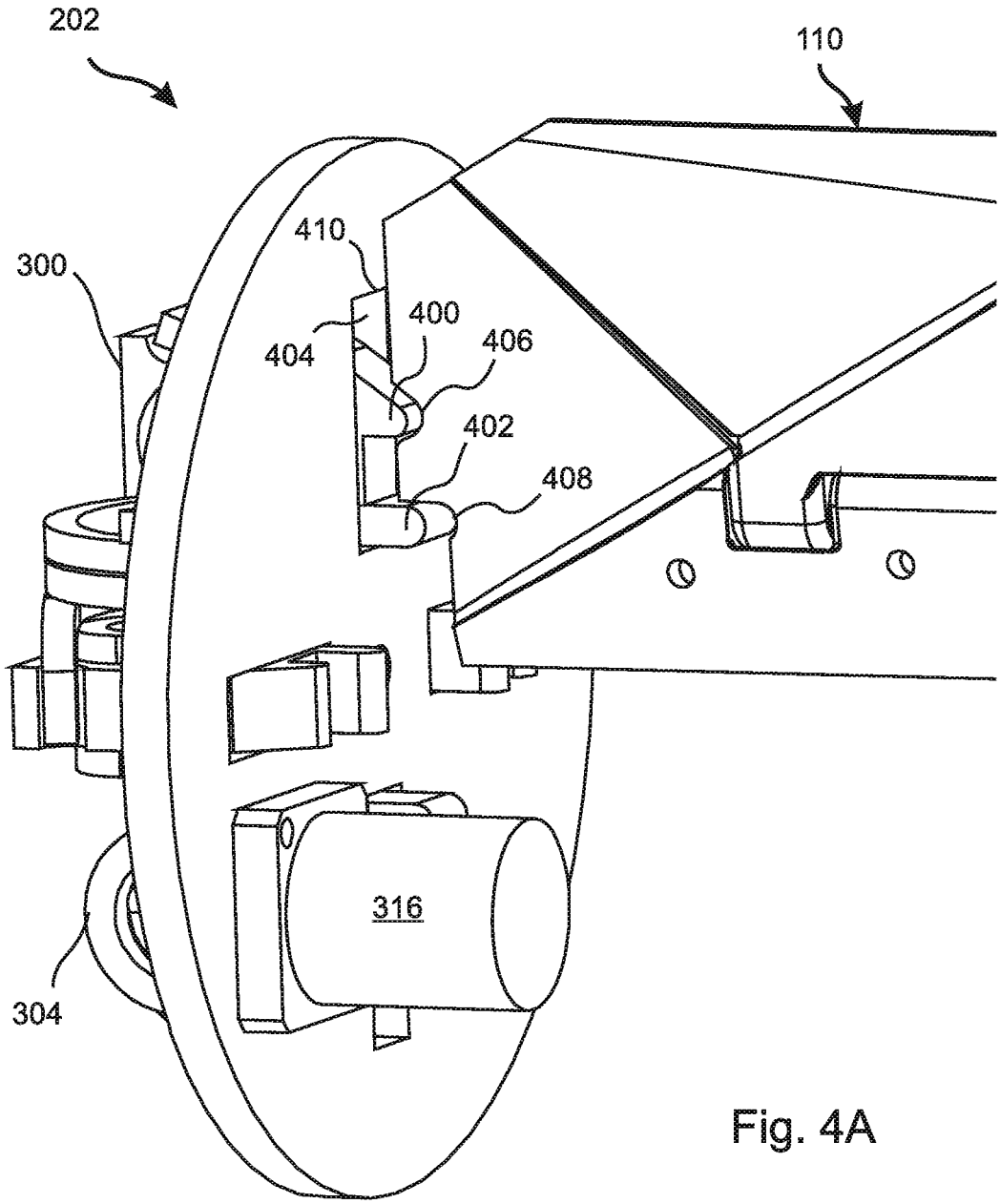
FIG. 4A is a perspective view from below, drawn to scale, of the embodiment of FIG. 3B.
Figure 4B:
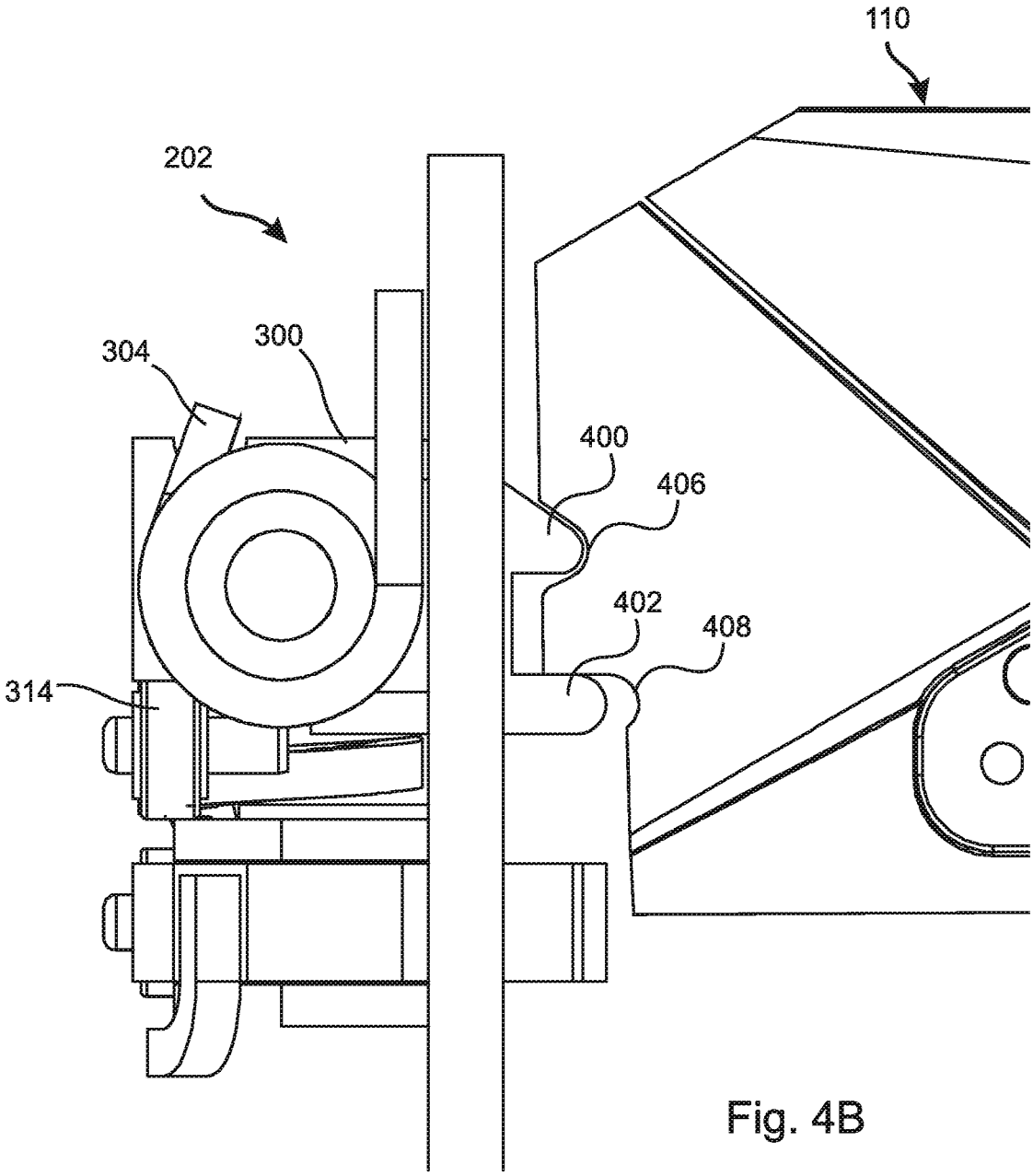
FIG. 4B is a side view, drawn to scale, of the embodiment of FIG. 4A.

FIG. 4A is a bottom perspective view and FIG. 4B is a side view of the embodiment of FIGS. 3A-3C, where the projectile 106 is shown in a substantially horizontal orientation. It can be seen in the figures that each of the flippers 300 includes two flipper tabs 400, 402 that extend through a flipper slot 404 provided in the baseplate 310 of the initiator 202 and engage with corresponding wing notches 406, 408 provided at the proximal end of the wing 110. The radially outer tab 400 as shown in the figures is a locking tab that engages with a locking notch 406 in the wing 110 and locks the wing 110 in its stowed configuration within the projectile 106 until deployment of the wing 110 is initiated. The radially inner tab 402 is a deployment tab that engages with the deployment notch 408 provided radially inward of the locking notch 406. During deployment, the deployment tab 402 transfers energy from the torsion spring 304 to the deployment notch 408, thereby assisting the guidance wing 110 to penetrate the frangible seal 206. In similar embodiments, a single tab and notch function as both the locking and deployment tab and notch, for example meshing with each other in a manner similar to the teeth of gears. In the embodiment of FIGS. 4A and 4B, on the other hand, the locking 400 and deployment 402 tabs and notches are distinct from each other.

Figure 5A:
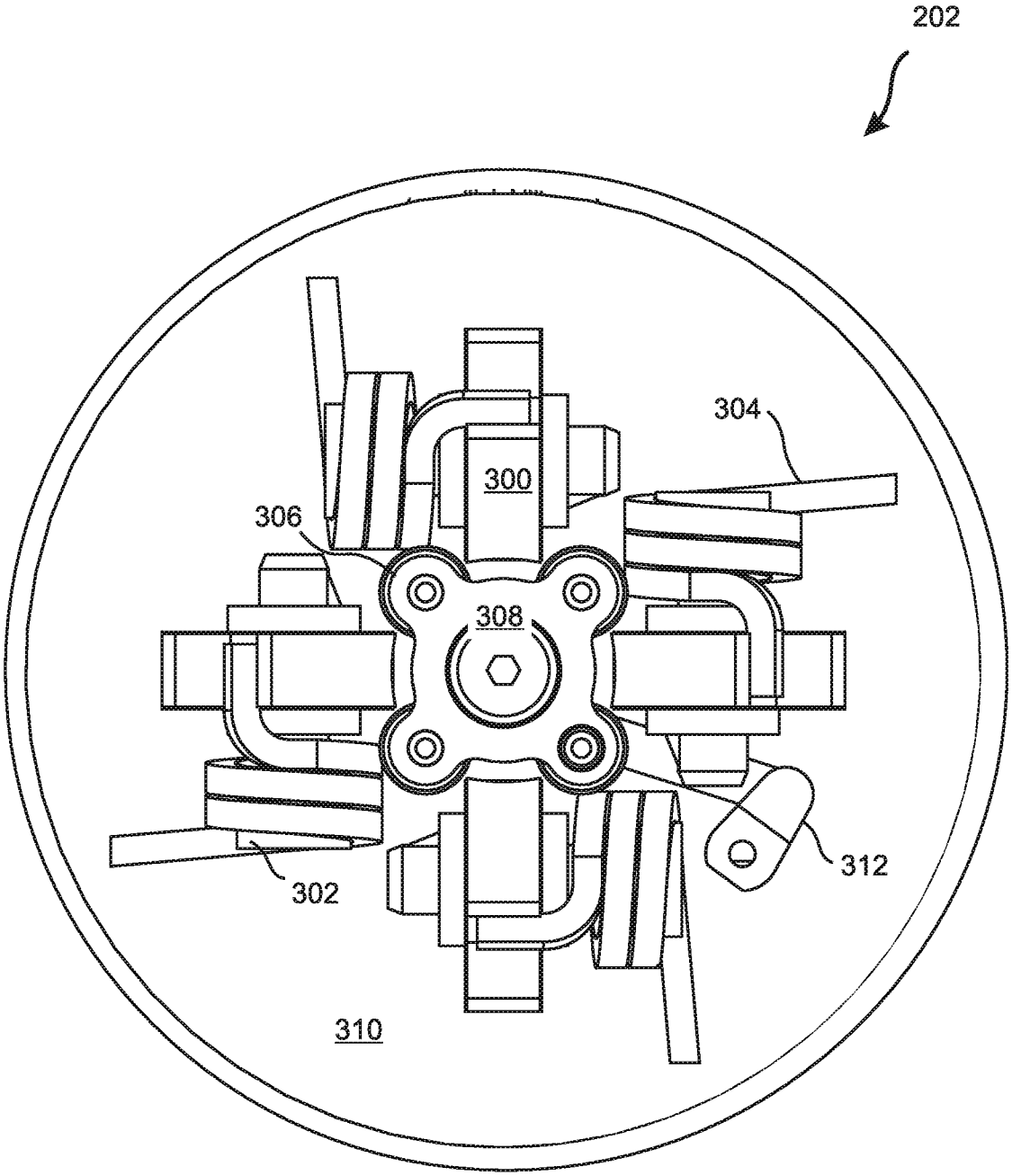
FIG. 5A is a top view, drawn to scale, of the embodiment of FIG. 3C, shown after wing deployment has been initiated.
Figure 5B:
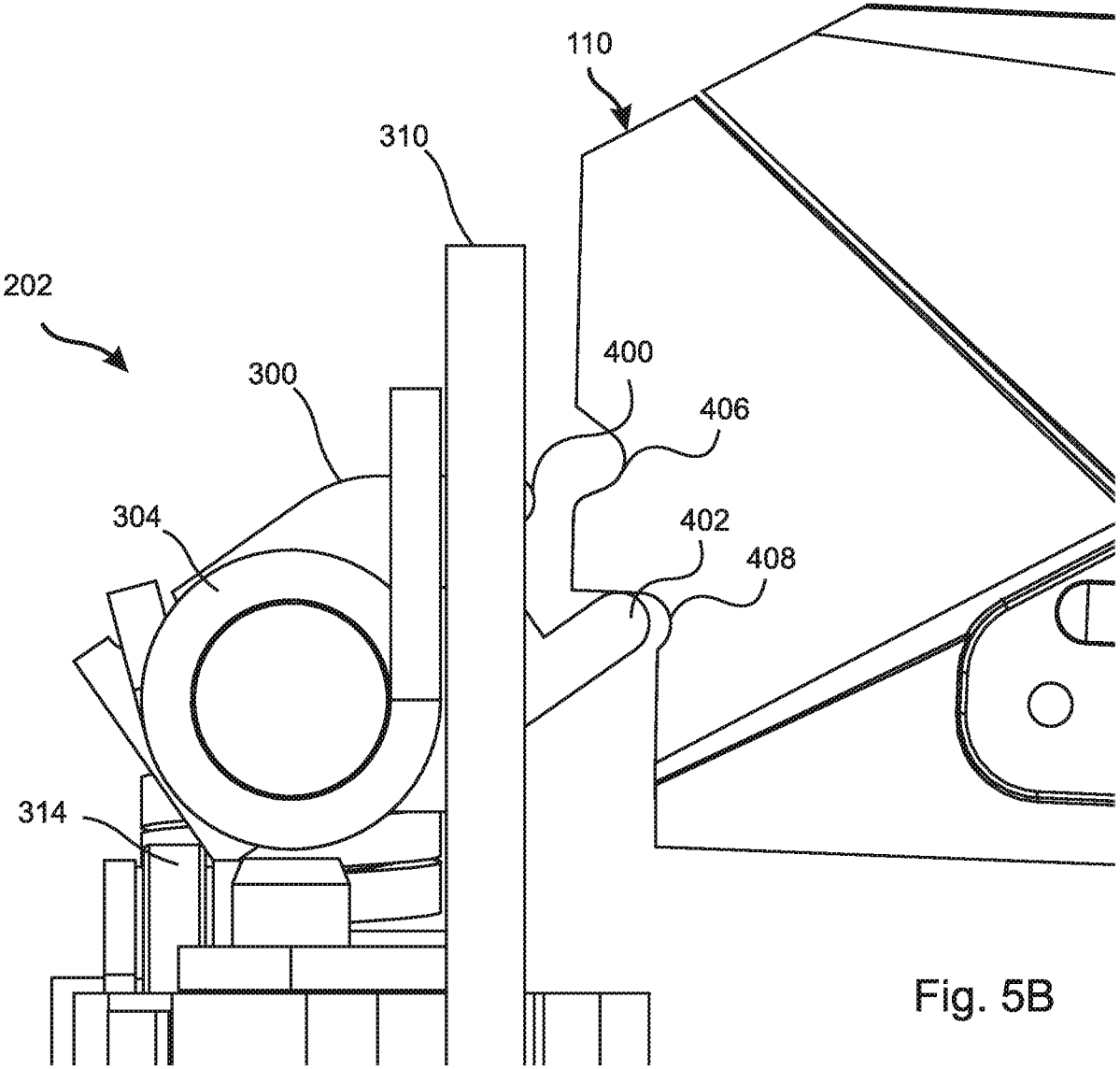
FIG. 5B is a side view drawn to scale of the embodiment of FIG. 5A.

With reference again to FIG. 3B, the central hub 308 is configured to rotate about an axis that is coaxial with a central axis of the projectile 106 from a first hub orientation to a second hub orientation. In FIGS. 3A-4B the central hub 308 is shown in its first hub orientation. With reference to FIGS. 5A and 5B, rotation of the hub 308 to the second hub orientation causes the lobes 306 to be rotationally offset from the flippers 300, thereby allowing the flippers 300 to be rotated about their flipper axes by the associated torsion springs 304, which causes the locking tabs 400 to be withdrawn from the locking notches 406 of the wings 110 so that the initiator tabs 402 can apply torque to the initiator notches 408 and thereby energetically boost the tips of the wings 110 through the frangible seals 206, thereby assisting deployment of the wings 110.

In the illustrated embodiment, the outer edge 410 of the flipper slot 404 (see FIG. 4A) serves as a "hard stop" that limits the rotation of the flipper 300 such that the deployment tab 402 continues to extend beyond the actuator plate 310 after the guidance wing 110 has been deployed. The inner edge of the deployment slot 408 is extended inward to the inner side of the wing 110. This allows the wing 110 to be deployed without full retraction of the deployment tab 402, and also allows the wing 110 to be easily re-stowed if necessary by simply pressing the wing 110 back through the wing slot 206, whereby the deployment slot 408 recaptures the deployment tab 402 and rotates the flipper 300 back to its first position, thereby re-engaging the locking pin 400 with the locking slot 406. Rotation of the central hub 308 back to its first hub orientation then completes the re-stowage of the wing 110.

Figure 6A:
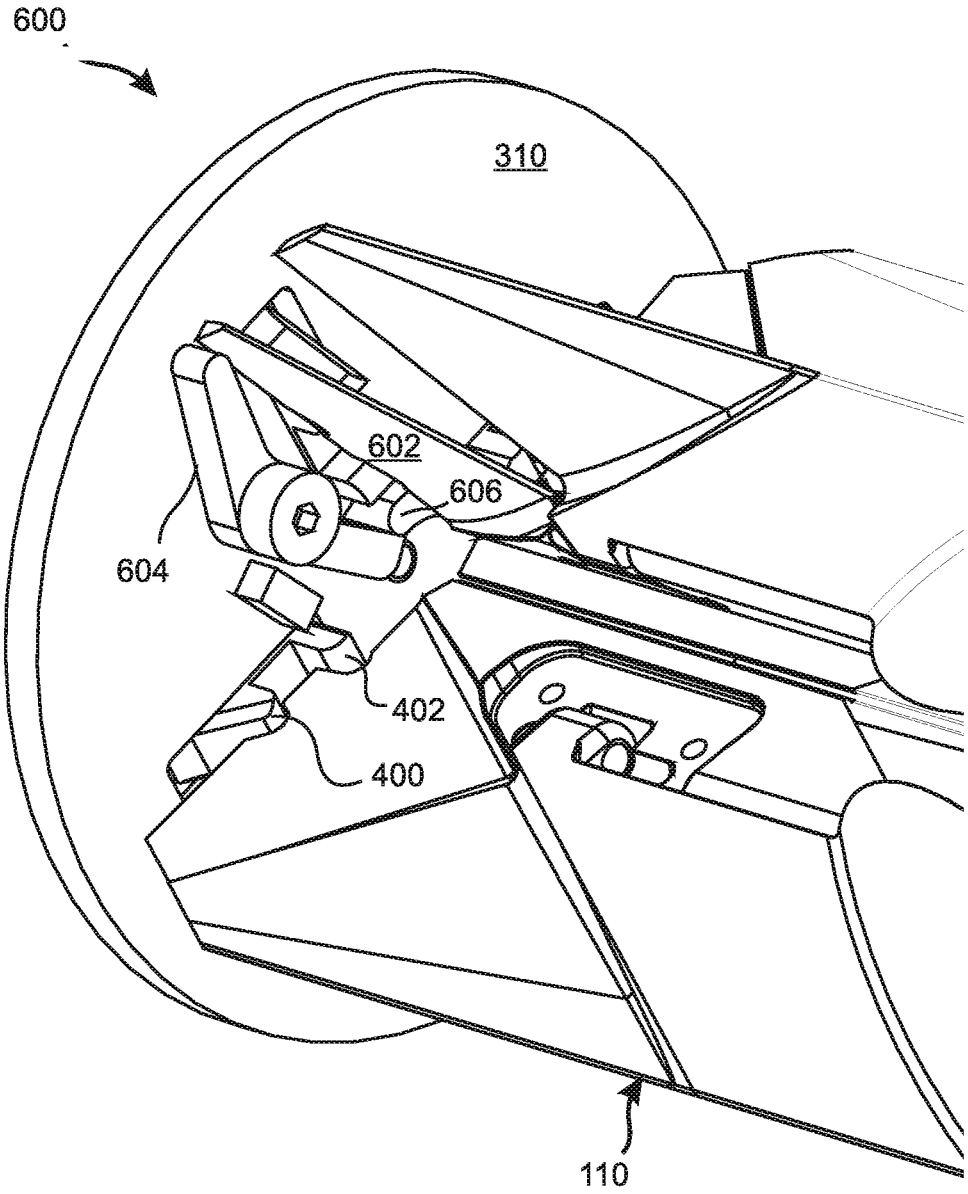
FIG. 6A is a perspective view from below, drawn to scale, of an embodiment of the present disclosure wherein the deployment actuator is a linkage cooperative with a control surface of a wing of the APKWS, the embodiment being shown before initiation of wing deployment.
Figure 6B:
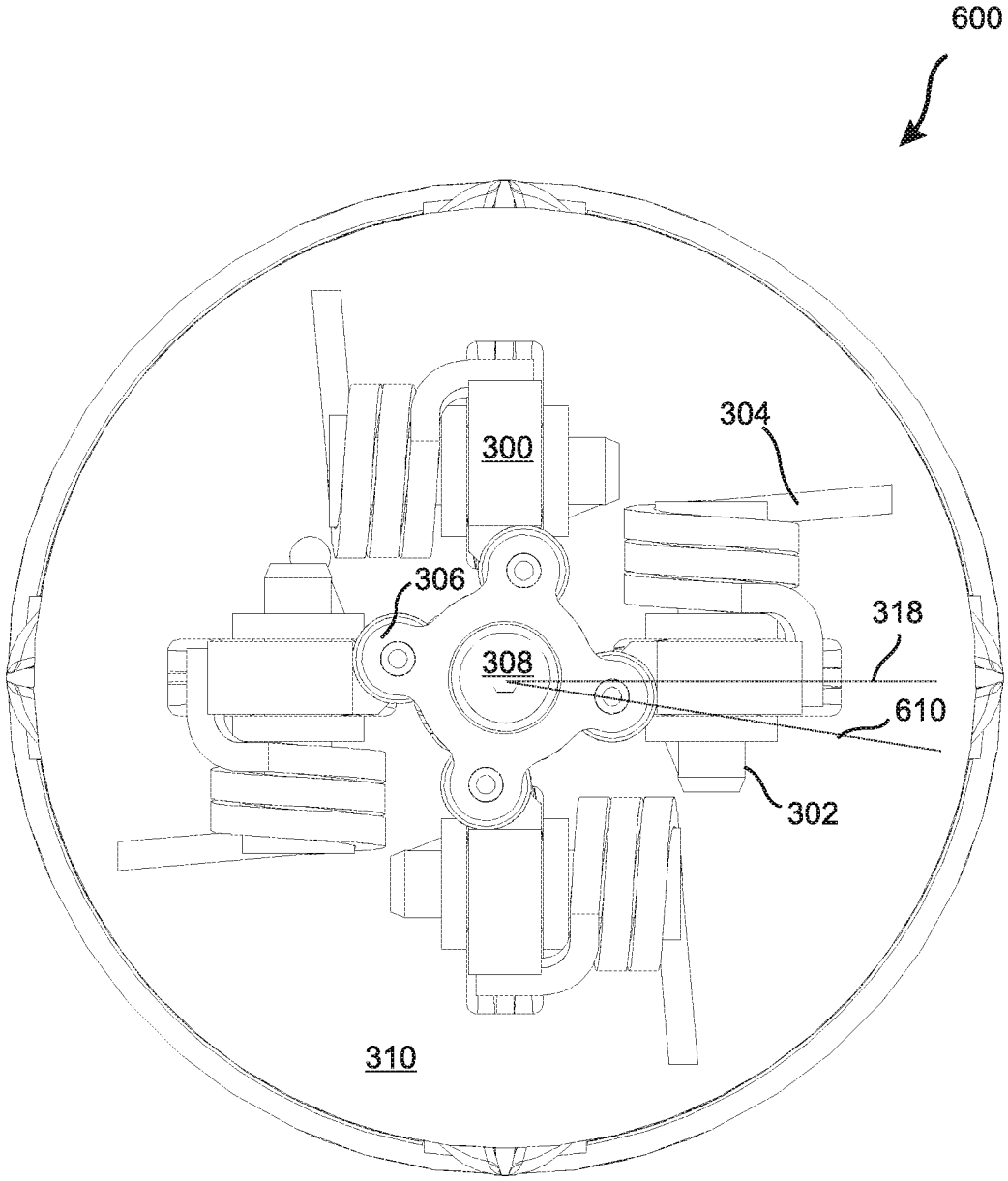
FIG. 6B is a top view drawn to scale of the embodiment of FIG. 6A.

In the embodiment of FIGS. 2A-5B, a linkage 312 operated by an electrically driven actuator, such as rotary solenoid 316 or DC motor, is used to maintain the rotational position of the hub 308 while the guidance wings 110 are stowed, and to rotate the hub 308 after launch so as to initiate deployment of the guidance wings 110. With reference to FIG. 6A, in other embodiments 600 wherein the guidance wings 110 include rotatable control surfaces 602, the control surface 602 of one of the wings is used to prevent rotation of the hub 308 when the wings 110 are stowed, and to allow hub rotation after launch of the missile. With reference to FIG. 6B, in some of these embodiments, when the wings 110 are stowed and the central hub 308 is in its first, pre-deployment orientation, the lobe radius 610 for each wing is misaligned with the offset radius 318 of the associated flipper 300, as shown in the figure. As a result, the pressure that is applied to the lobe 306 by the flipper 300, due to the torque applied to the flipper 300 by the torsion spring 304, is not aligned with the lobe radius, which results in application of a rotational "feedback" torque to the central hub 308.

Figure 6C:
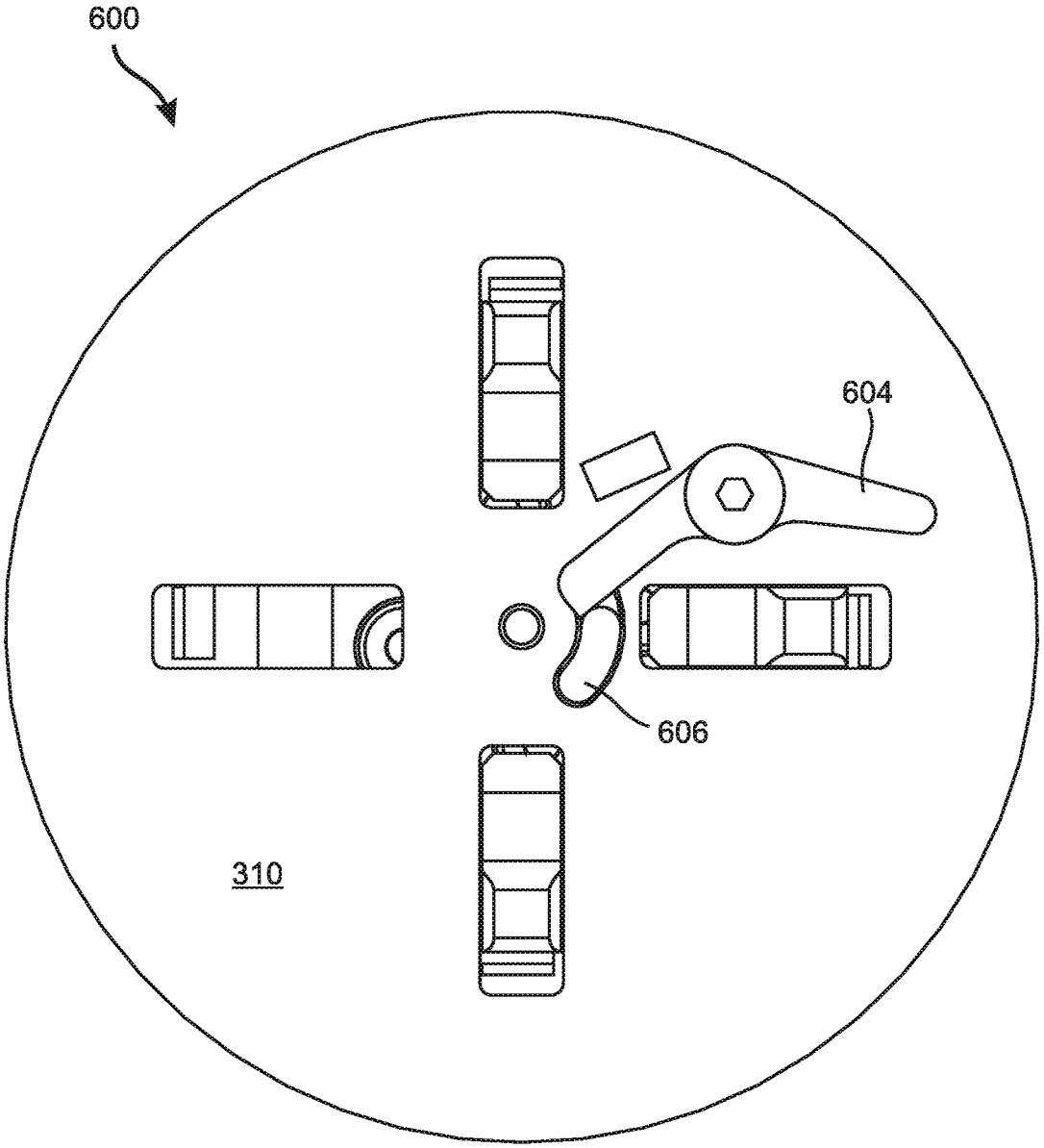
FIG. 6C is a bottom view drawn to scale of the embodiment of FIG. 6A, shown with all wings removed.
Figure 6D:
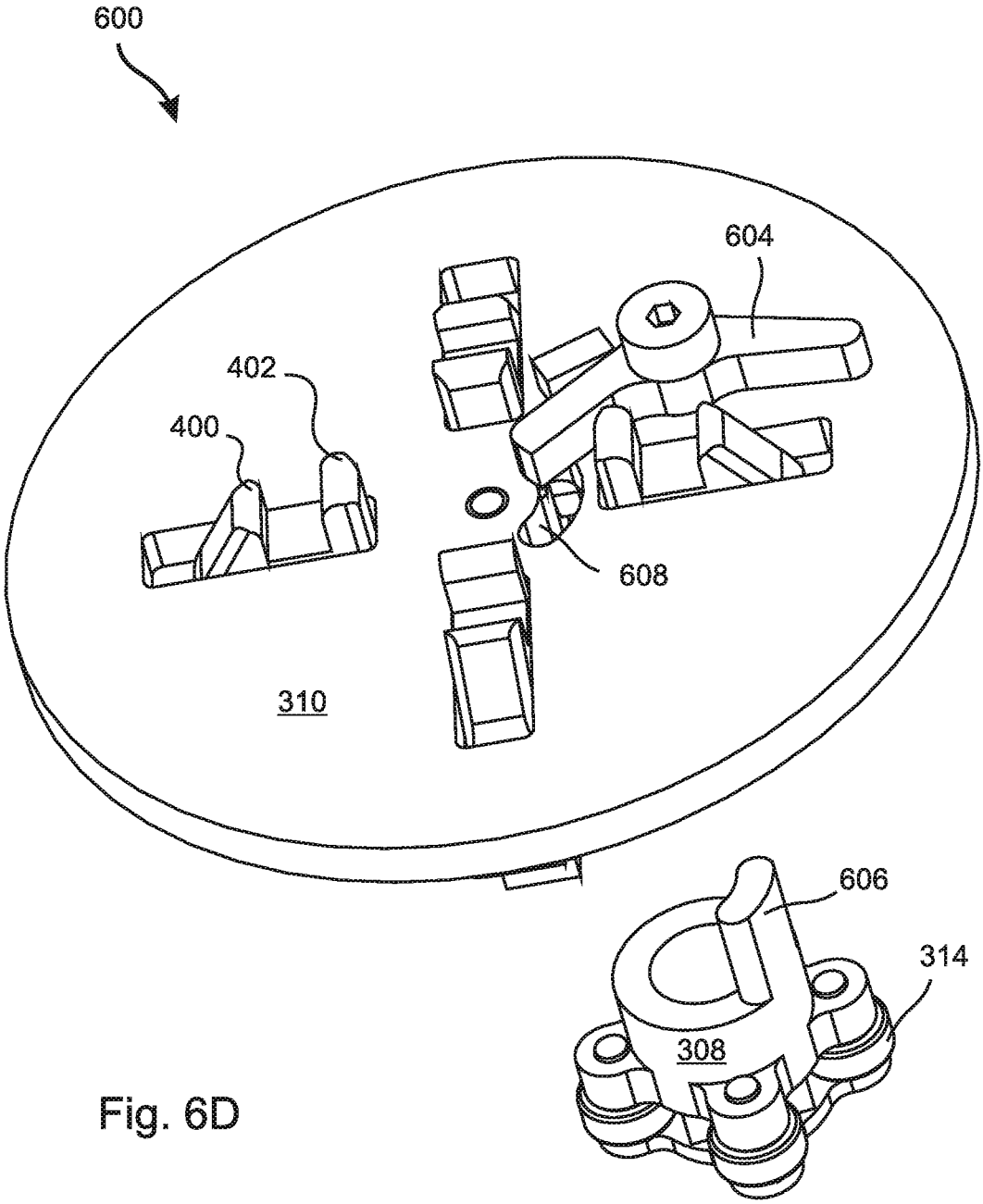
FIG. 6D is a perspective view from below, drawn to scale, of the embodiment of FIG. 6C, shown with the central hub removed and placed beside the initiator baseplate.

Before deployment, in embodiments and with reference again to FIG. 6A, this feedback torque applied to the central hub 308 is resisted by a rocker link 604 that is blocked from "rocking" by the control surface 602. In the illustrated embodiment, the rocking link 604 prevents movement of a linkage pin 606 that is fixed to the hub 308 and extends through a linkage slot 608 provided in the initiator baseplate 310. FIG. 6C is a view of the rear surface of the initiator plate 310 shown with all of the wings removed, so that the relationship between the rocker link 604 and the linkage pin 606 is clearly visible. FIG. 6D is a perspective view from the rear of the same embodiment, shown with the hub 308 removed from the initiator baseplate 310 and set to the side, so that the relationship between the hub 308 and the linkage pin 606 is clearly visible, and so that the linkage slot 608 in the initiator plate through which the linkage pin 606 is slidingly inserted can be easily viewed.

Figure 7:
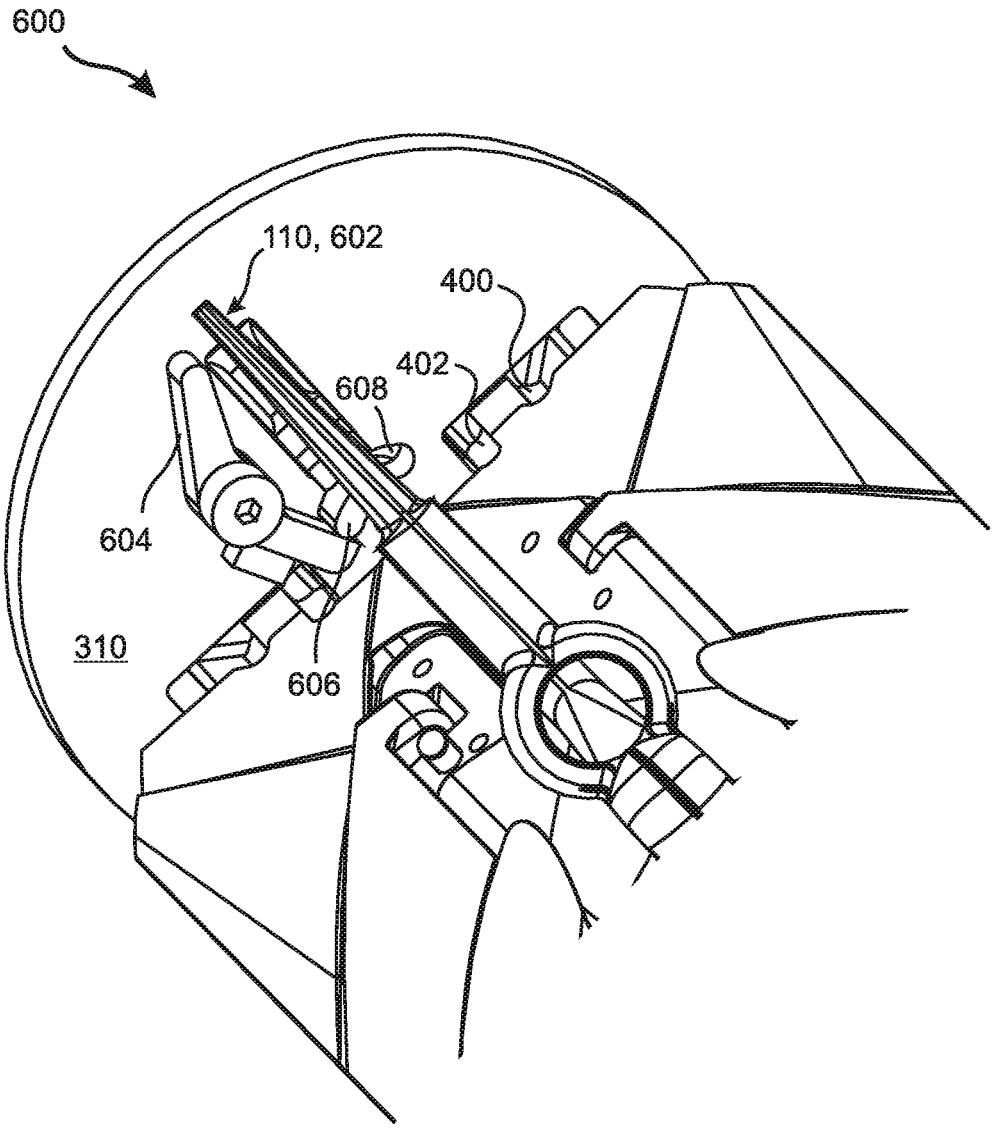
FIG. 7 is a perspective view from below, drawn to scale, of the embodiment of FIG. 6A shown after initiation of wing deployment.

In embodiments, the control surface 602 of the wing 110 is driven by the missile electronics via a motor and gear train, wherein the gear train is designed such that the control surface 602 cannot be back-driven, and so the reactive force applied to the control surface 602 by the rocker link 604 cannot cause the control surface 602 to rotate. With reference to FIG. 7, in these embodiments, wing deployment is initiated simply by causing the wing electronics to rotate the control surface 602 away from the rocker link 604, for example to a "faired" position as shown in FIG. 7 where the control surface 602 is in line with the remainder of the wing 110, whereupon the rocker link 604 is free to pivot, allowing the linkage pin 606 to move within the linkage slot 608, and allowing the spring-driven torque that is applied by the flippers 300 to the lobes 306 to rotate the hub 308 about its axis until the flippers 300 are free to rotate and thereby to initiate deployment of the wings 110. FIG. 7 shows this configuration at the moment where the flippers 300 have been released but before they have begun to deploy the wings 110.

The foregoing description of the embodiments of the disclosure has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the disclosure to the precise form disclosed. Many modifications and variations are possible in light of this disclosure.

Although the present application is shown in a limited number of forms, the scope of the disclosure is not limited to just these forms, but is amenable to various changes and modifications without departing from the spirit thereof. The disclosure presented herein does not explicitly disclose all possible combinations of features that fall within the scope of the disclosure. The features disclosed herein for the various embodiments can generally be interchanged and combined into any combinations that are not self-contradictory without departing from the scope of the disclosure. In particular, the limitations presented in dependent claims below can be combined with their corresponding independent claims in any number and in any order without departing from the scope of this disclosure, unless the dependent claims are logically incompatible with each other.

What is claimed is:

1. A wing deployment initiator configured for initiating deployment from a stowed configuration of a guidance wing of a projectile, the wing deployment initiator comprising:

a flipper configured to be rotated about a flipper axis from a first flipper position to a second flipper position by a deployment spring, the flipper when in the first flipper position being configured to retain the guidance wing in its stowed configuration, the flipper when rotated from the first flipper position to the second flipper position being configured to release the guidance wing and to transfer deployment energy from the deployment spring to the guidance wing, thereby energetically initiating deployment of the guidance wing;

a central hub configured to be rotated about a vertical hub axis by a hub actuator, the central hub including a lobe extending radially toward the flipper, said lobe being configured to maintain the flipper in the first flipper position when the central hub is in a first hub orientation, and to permit the flipper to rotate to the second flipper position when the central hub is in a second hub orientation; and wherein the flipper axis is perpendicular to the vertical hub axis.

2. The wing deployment initiator of claim 1, wherein the flipper is pivotally mounted to a horizontal initiator baseplate and extends above an upper surface of the initiator baseplate, said flipper being radially offset from the central hub along an offset radius extending from the central hub to the flipper, the flipper being configured to rotate about a horizontal flipper axis that is perpendicular to the offset radius.

3. The wing deployment initiator of claim 1, wherein the deployment spring is a torsion spring.

4. The wing deployment initiator of claim 1, wherein the lobe is in abutting contact with a radially inward facing surface of the flipper when the hub is in the first hub orientation and the flipper is in the first flipper position, thereby inhibiting the flipper from rotating, and the lobe is rotationally offset from the flipper when the central hub is in the second hub orientation, thereby enabling the flipper to rotate from the first flipper position to the second flipper position.

5. The wing deployment initiator of claim 4, wherein the lobe comprises a bearing or roller configured to roll against the radially inward facing surface of the flipper as the hub is rotated from the first hub orientation to the second hub orientation.

6. The wing deployment initiator of claim 1, wherein the flipper further comprises a locking flipper tab and a deployment flipper tab configured such that:

when the guidance wing is in its stowed configuration and the flipper is in the first flipper position, the locking flipper tab engages with a corresponding locking wing notch provided in the guidance wing, whereby mutual engagement of the locking flipper tab and locking wing notch restrains the guidance wing from being deployed; and as the flipper rotates from the first flipper position to the second flipper position, the deployment flipper tab transfers the deployment energy from the deployment spring to the guidance wing.

7. The wing deployment initiator of claim 6, wherein the locking flipper tab is the deployment flipper tab.

8. The wing deployment initiator of claim 6, wherein the locking flipper tab is distinct from the deployment flipper tab.

9. The wing deployment initiator of claim 1, wherein the guidance wing is included in a plurality of guidance wings that are symmetrically located about the vertical hub axis, and wherein for each of the guidance wings, the wing deployment initiator includes a corresponding lobe, flipper, and spring configured to maintain the guidance wing in its stowed configuration when the central hub is in the first hub orientation, and to energetically initiate deployment of the guidance wing when the central hub is rotated by the hub actuator to the second hub orientation.

10. The wing deployment initiator of claim 1, wherein the hub actuator is an electrically driven actuator.

11. The wing deployment initiator of claim 10, wherein the hub actuator is a rotary solenoid or DC motor that is coupled to the central hub by a linkage.

12. The wing deployment initiator of claim 1, wherein:

the guidance wing includes a control surface that can be deflected by control electronics of the projectile;

the flipper is offset from the central hub along a flipper offset radius extending from the central hub to the flipper;

the lobe extends radially outward from the central hub along a lobe radius;

when the central hub is in its first orientation, the lobe abuts an inward facing surface of the flipper, but the lobe radius is not aligned with the flipper offset radius, such that pressure applied to the lobe by the flipper arising from torque applied to the flipper by the deployment spring results in application of a feedback torque to the central hub; and the hub actuator is configured such that rotation of the central hub is inhibited by the control surface when the control surface is in a first control surface alignment, and rotation of the central hub according to the feedback torque is enabled when the control surface is moved by the control electronics of the projectile to a second control surface alignment.

13. The wing deployment initiator of claim 12, wherein the control surface is driven by the control electronics of the projectile via a gear train that cannot be back-driven.

14. The wing deployment initiator of claim 12, wherein the control surface is deflected out of alignment with the guidance wing when the control surface is in the first control surface alignment, and wherein the control surface is in alignment with the guidance wing when the control surface is in the second control surface alignment.

15. A projectile comprising:

a fuselage;

a guidance wing hinged at a distal end thereof so as to enable a proximal end of the guidance wing to pivot outward during a wing deployment thereof through a corresponding wing slot provided in the fuselage; and a wing deployment initiator configured for initiating deployment of the guidance wing from a stowed configuration, the wing deployment initiator comprising:

a flipper configured to be rotated about a flipper axis from a first flipper position to a second flipper position by a deployment spring, the flipper when in the first flipper position being configured to retain the guidance wing in its stowed configuration, the flipper when rotated from the first flipper position to the second flipper position being configured to release the guidance wing and to transfer deployment energy from the deployment spring to the guidance wing, thereby energetically initiating deployment of the guidance wing; and a central hub configured to be rotated about a vertical hub axis by a hub actuator, the central hub including a lobe extending radially toward the flipper, said lobe being configured to maintain the flipper in the first flipper position when the central hub is in a first hub orientation, and to permit the flipper to rotate to the second flipper position when the central hub is in a second hub orientation; and wherein the flipper axis is perpendicular to the vertical hub axis.

16. The projectile of claim 15, further comprising a frangible seal covering the wing slot, deployment of the guidance wing thereby requiring that the guidance wing penetrate through the frangible seal.

17. The projectile of claim 15, wherein the lobe comprises a bearing or roller configured to roll against a radially inward facing surface of the flipper as the hub is rotated from the first hub orientation to the second hub orientation.

18. The projectile of claim 15, wherein the guidance wing is included in a plurality of guidance wings that are symmetrically located about a central axis of the projectile, and wherein for each of the guidance wings the projectile includes a corresponding lobe, flipper, and deployment spring configured to maintain the guidance wing in its stowed configuration when the central hub is in the first hub orientation, and to energetically initiate deployment of the guidance wing when the central hub is rotated by the hub actuator to the second hub orientation.

19. The projectile of claim 15, wherein:

the guidance wing includes a control surface that can be deflected by control electronics of the projectile;

the flipper is offset from the central hub along a flipper offset radius extending from the central hub to the flipper;

the lobe extends radially outward from the central hub along a lobe radius;

when the central hub is in its first orientation, the lobe abuts an inward facing surface of the flipper, but the lobe radius is not aligned with the flipper offset radius, such that pressure applied to the lobe by the flipper arising from torque applied to the flipper by the deployment spring results in application of a feedback torque to the central hub; and the hub actuator is configured such that rotation of the central hub is inhibited by the control surface when the control surface is in a first control surface alignment, and rotation of the central hub according to the feedback torque is enabled when the control surface is moved by the control electronics of the projectile to a second control surface alignment.

20. The projectile of claim 19, wherein the control surface is driven by the control electronics of the projectile via a gear train that cannot be back-driven.

21. The projectile of claim 19, wherein the control surface is deflected out of alignment with the guidance wing when the control surface is in the first control surface alignment, and wherein the control surface is in alignment with the guidance wing when the control surface is in the second control surface alignment.

* * * * *